United States Patent [19]

Kloepfer

[11] 3,992,059

[45] Nov. 16, 1976

[54] SEAT EDGE CONSTRUCTION

[75] Inventor: Henry L. Kloepfer, Thornhill, Canada

[73] Assignee: Lear Siegler, Inc., Santa Monica, Calif.

[22] Filed: Oct. 6, 1975

[21] Appl. No.: 619,730

[52] U.S. Cl. ..... 297/452; 5/260; 267/102; 297/396

[51] Int. Cl.[2] ..... A47C 7/02

[58] Field of Search ..... 267/102, 107, 112; 297/396, 452; 5/259 R, 259 B, 260

[56] References Cited

UNITED STATES PATENTS

| | | | |
|---|---|---|---|
| 2,848,038 | 8/1958 | Bank et al. | 267/102 |
| 3,095,189 | 6/1963 | Slominski | 267/102 |

*Primary Examiner*—James C. Mitchell
*Attorney, Agent, or Firm*—Reising, Ethington, Barnard, Perry and Brooks

[57] ABSTRACT

A seat of the disclosure has an exposed edge construction that reduces the seat padding necessary to cushion a frame portion extending along the seat edge. The seat edge construction may be utilized with either the seat cushion or seat back of the seat and incorporates auxiliary sinuous springs having first ends supported by primary sinuous springs so as to extend therefrom in a cantilevered manner. The auxiliary springs extend over the adjacent frame portion with a curved configuration that is convex with respect to seat padding supported by these springs. Second ends of the auxiliary springs are secured to the frame portion on the opposite side thereof from their first ends.

7 Claims, 2 Drawing Figures

SEAT EDGE CONSTRUCTION

BACKGROUND OF THE INVENTION

1. Field of the Invention

The present invention relates to seat constructions for exposed seat edges which incorporate auxiliary sinuous springs supported by primary sinuous springs so as to permit cushioning of the seat edges with a minimum of padding.

2. Description of the Prior Art

Prior art seats have incorporated edge constructions wherein auxiliary sinuous springs are supported by primary sinuous springs to reduce the amount of padding necessary to cushion exposed edges of the seat. Such a seat edge construction is shown by the expired patent of Vogel U.S. Pat. No. 2,787,317. This patent discloses an auxiliary sinuous spring that sits on top of a primary sinuous spring adjacent an exposed edge of a seat cushion of the seat. The auxiliary spring has a portion that extends outwardly to support seat cushion padding. Conventionally, it has been the practice to use an additional padding wedge with such auxiliary springs, in addition to the padding layer used over the rest of the seat, so as to aid in preventing the seat occupant from feeling a hard seat frame portion adjacent the auxiliary springs.

Also, the prior art patent of Bartlett et al U.S. Pat. No. 2,420,220 discloses a seat back construction wherein the upper end of a seat back is provided with coil springs for spacing padding with respect to an upper frame portion of the seat back.

SUMMARY OF THE INVENTION

The present invention is directed toward a seat having an improved edge construction with primary sinuous springs supporting auxiliary sinuous springs to provide padding support adjacent exposed edges of the seat in a spaced relationship to adjacent frame portions. The seat edge construction is disclosed as beind used at the forward exposed edge of a horizontal seat cushion, although it could also be utilized on exposed side edges of a seat cushion. Likewise the seat edge construction is also disclosed as being used at the upper end of a vertical seat back of the seat.

The seat cushion edge construction incorporates a plurality of auxiliary sinuous springs respectively associated with a plurality of primary sinuous springs. The primary sinuous springs extend between spaced portions of the seat frame. One of these frame portions extends alongside an exposed edge of the seat. The auxiliary springs have first ends respectively secured to intermediate portions of the primary springs adjacent the one frame portion. The auxiliary springs extend over the adjacent frame portion in a cantilevered manner with curved configurations that are convex with respect to padding supported by these springs. Second ends of the auxiliary springs are secured to the one frame portion on the opposite side thereof from the first ends of the auxiliary springs.

The auxiliary springs are preferably secured to the primary springs by clips and to the adjacent frame portion by one or more flexible members. The auxiliary springs are also preferably secured to each other, as are the primary springs, by elongated wire-like members and suitable clips.

When the seat edge construction is utilized at the front edge of a seat cushion, the primary and auxiliary springs extend forwardly and rearwardly with respect to the seat. When the seat edge construction is utilized at the upper edge of the vertical seat back, the springs extend vertically and the primary springs include lower portions that are also convex with respect to the seat back padding below the convex auxiliary springs.

The objects, features and advantages of the present invention are readily apparent from the following detailed description of a preferred embodiment taken in connection with the accompanying drawings.

DETAILED DESCRIPTION OF THE PREFERRED EMBODIMENT

Figure 1:
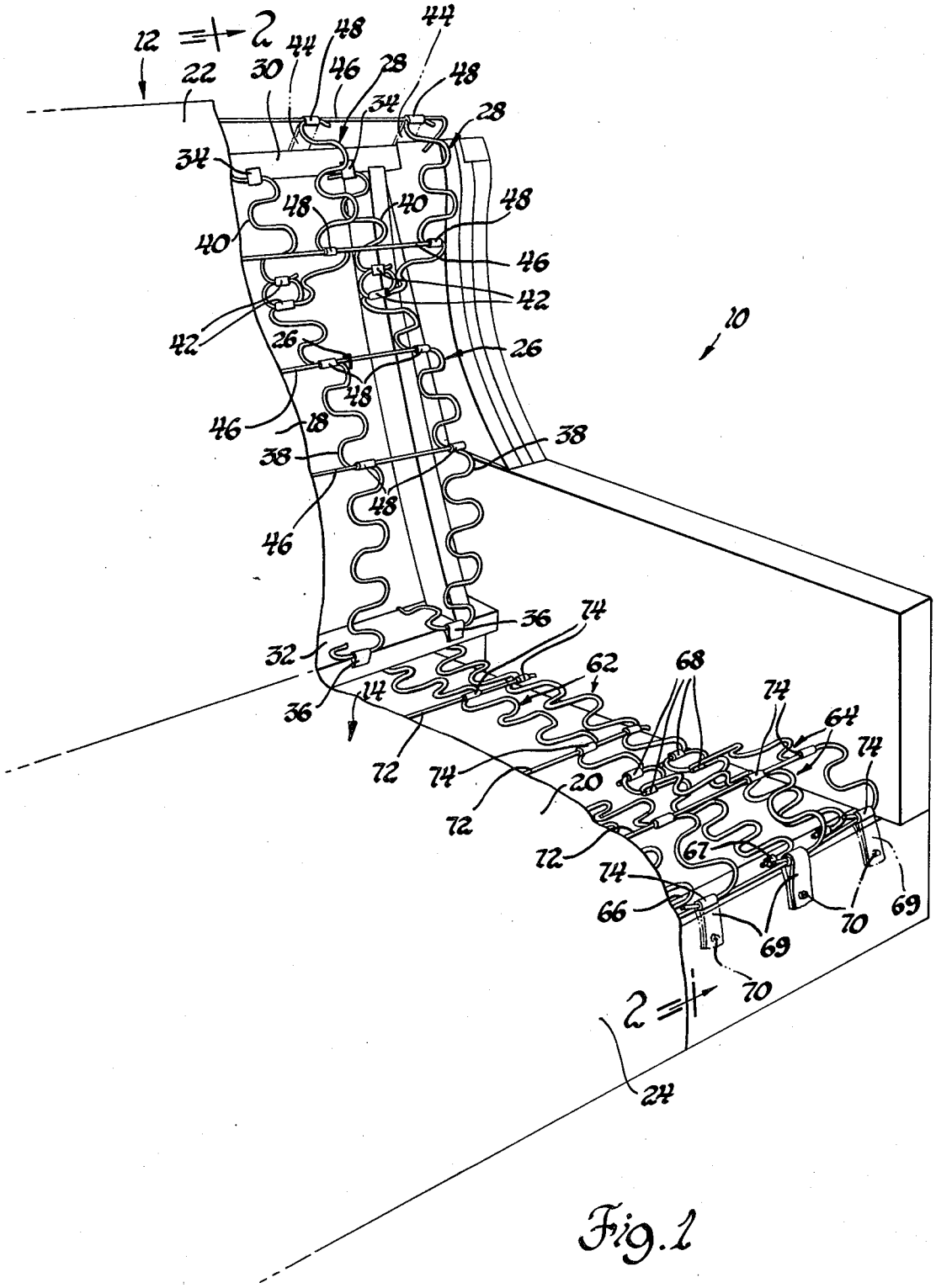
FIG. 1 is a perspective view of a seat embodying the present invention, with padding of a seat removed in certain areas to show sinuous springs that support the padding on the seat.

Referring to FIG. 1 of the drawings, reference numeral 10 indicates a seat that embodies the present invention. The seat includes a generally vertical seat back 12 as well as a generally horizontal seat cushion 14. Padding 18 is utilized to cover the seat back 12 and padding 20 is utilized to cover the seat cushion 14. The padding 18 adjacent an upper edge 22 of seat back 12 is supported by sinuous springs in accordance with the invention as is the padding 20 adjacent a forward exposed edge 24 of seat cushion 14.

As shown in FIG. 1, the seat back 12 of the seat includes a plurality of primary sinuous springs 26 and a plurality of auxiliary sinuous springs 28 respectively associated with the primary springs. The primary springs 26 extend vertically between upper and lower frame portions 30 and 32 with sinuous configurations so as to provide support for the seat back padding 18 for the lower two-thirds or so of the seat back height. The upper ends of the primary springs 26 are secured to the frame portion 30 by clips 34 and their lower ends are secured to the lower frame portion 32 by clips 36. The frame portions 30 and 32 extend laterally with respect to the seat and are preferably made from wood when the seat is designed for furniture usage. However, the seat could also be utilized for vehicle usage and the frame portions would then be constructed from metal. Likewise, the frame portions could be made from other suitable materials.

Figure 2:
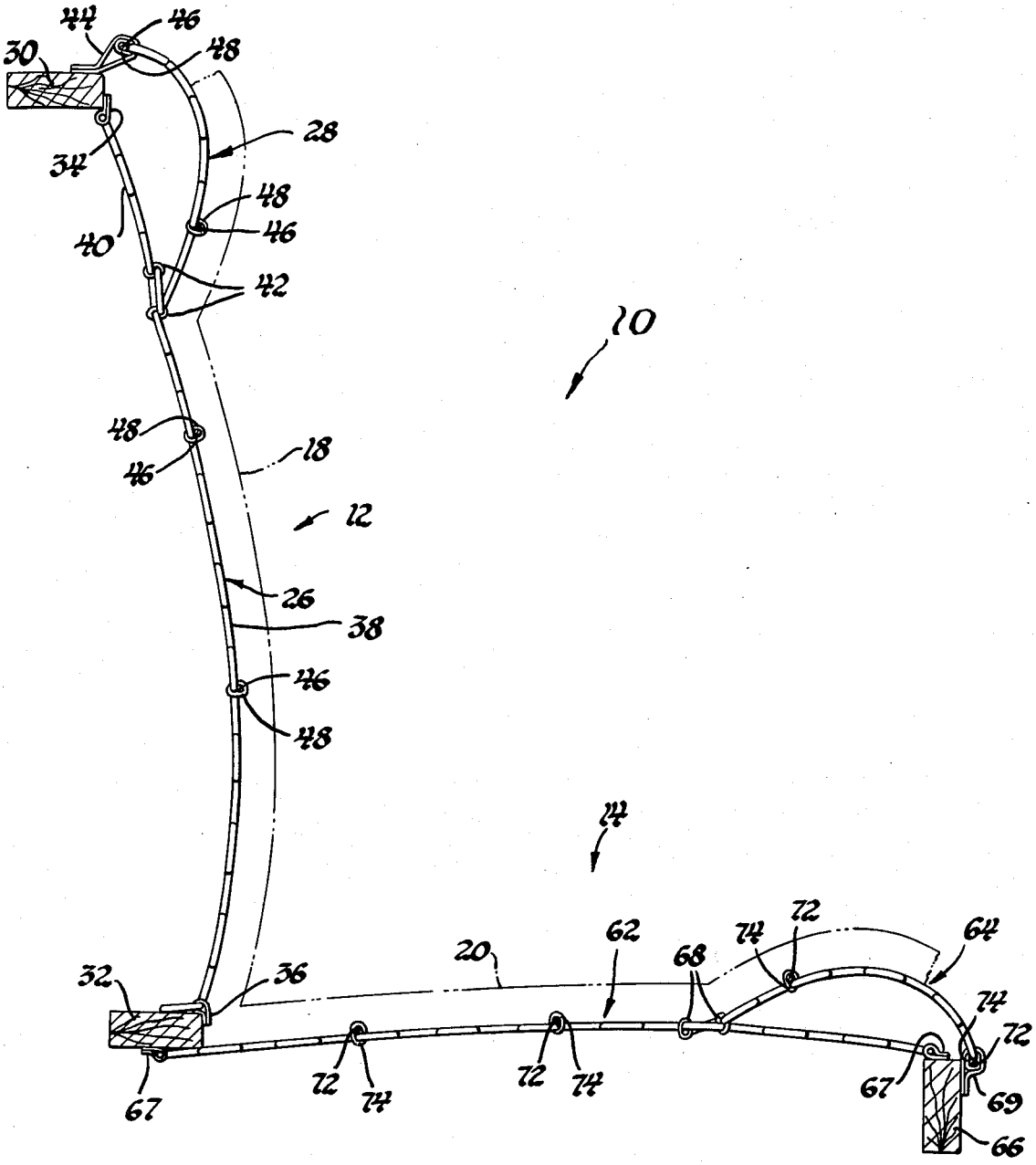
FIG. 2 is a side view taken along line 2-2 of FIG.1 showing a seat back and seat cushion of the seat, each of which has an edge construction embodying the invention.

As seen in FIG. 2, the primary springs 26 of the seat back include lower portions 38 which are convex in a forwardly facing direction where they support the seat back padding. The primary springs also include upper portions 40 that extend in a generally vertical direction between the upper ends of the lower portions 38 and the upper frame portion 30.

Each auxiliary spring 28 has a lower end secured to the juncture between the upper and lower portions of its associated primary spring by suitable clips 42. The auxiliary springs 28 extend upwardly in a cantilevered manner from the primary springs 26 in front of the upper frame portion 30 with sinuous configurations for supporting the seat back padding. The auxiliary springs are curved in front of the frame portion 30, FIG. 2, with curved configurations that are convex with respect to the seat back padding 18 to give the seat back a head-rest contour. The upper ends of the auxiliary springs 28 are located above the frame portion 30 and are secured to its upper side by flexible members such as the cloth-like strips 44 shown by phantom lines. Likewise, a piece of twine or the like could also be used to secure the upper spring ends to the frame portion 30. The upper ends of the springs are preferably slightly preloaded in a rearward direction so as to be in alignment with each other.

As shown in FIG. 1, a plurality of wire-like members 46 and clips 48 are utilized to interconnect the auxiliary sinuous springs 28 of the seat back 12 as well as the lower portions 38 of the primary seat back springs 26. These wire-like members 46 extend laterally with respect to the seat and provide additional support for the seat back padding 18 as well as interconnecting its springs with each other.

The seat back padding 18 is thus convex at two vertically spaced locations and concave intermediate these locations to provide the required back support and head support. The same thickness of seat back padding may be utilized over the extent of the seat back due to the curved configurations of the auxiliary spring 28 and the manner in which their ends are secured to the associated primary springs and frame portion.

The seat cushion 14 of seat 10 includes a plurality of primary sinuous springs indicated by reference numeral 62 as well as a plurality of auxiliary sinuous springs respectively associated with the primary springs and indicated by reference numeral 64. The primary springs 62 have sinuous configurations that support the rear two-thirds or so of the seat cushion padding 20. These primary springs extend in a generally horizontal manner between the frame portion 32 at the rear side of the seat and a front frame portion 66 that extends along the forward exposed edge of the seat cushion 14. Suitable attachment clips 67 are utilized to secure the front and rear ends of the primary springs 62 to their respective frame portions.

The auxiliary seat cushion springs 64 have rear ends mounted on the intermediate portions of the primary seat cushion springs 62 by suitable clips 68 between the horizontally spaced frame portions 32 and 66. These auxiliary springs 64 extend forwardly over the front frame portion 66 with sinuous configurations that support the seat cushion padding 20 adjacent the forward one-third or so of the cushion above the frame portion 66. The auxiliary springs are convex in an upwardly facing direction toward the seat cushion padding so this padding curves over the frame 66 in an arcuate manner to give the required contour. The forward ends of the auxiliary seat cushion springs 64 are secured to the forward side of the front frame portion 66 by generally flexible cloth-like strips 69 that are attached via nails 70 or the like. Likewise, a piece of twine or the like could also be utilized to secure the forward ends of the strips 64 to the frame portion 66. The front ends of the auxiliary springs 64 are preloaded slightly in a downward direction to align these springs and facilitate the installation of the seat cushion padding 20 during assembly of the seat. Also, the auxiliary springs 64 are interconnected with each other as are the rear portions of the primary springs 62 by laterally extending wire-like members 72 and clips 74. The wire-like members 72 provide additional support for the seat cushion padding 20 as well as interconnecting its springs with each other.

The same thickness of seat cushion padding 20 may be used over the extent of the seat cushion due to the convex curve configurations of the auxiliary seat cushion springs 64 and the manner in which the ends of these springs are secured to the primary seat cushion springs 62 and the front frame portion 66.

While detailed embodiments of the seat construction have herein been described, those skilled in the art will recognize various alternative embodiments of the invention as defined by the following claims.

What is claimed is:

1. A seat construction comprising: a frame including a first portion extending alongside an exposed edge of the seat and a second portion spaced from the first portion; a plurality of primary sinuous springs extending between the first and second frame portions with sinuous configurations so as to provide support for padding of the seat; a plurality of auxiliary sinuous springs respectively associated with the primary springs adjacent said exposed edge of the seat; the auxiliary springs having first ends secured to intermediate portions of the primary springs and extending toward the exposed edge of the seat with sinuous configurations that provide support for the padding of the seat adjacent the exposed edge thereof; the auxiliary springs extending over the first frame portion with a curved configuration that is convex with respect to the padding supported thereby so as to reduce the thickness of padding necessary to cushion said exposed edge of the seat; the auxiliary springs having second ends located adjacent the first frame portion on an opposite side thereof from their first ends; flexible members securing the second ends of the auxiliary springs to the first frame portion on the opposite side thereof from the first ends of the auxiliary springs; and padding of a uniform thickness covering the primary springs and the auxiliary springs and providing the required resiliency over the first frame portion due to the curved configuration of the auxiliary springs and the securement of the second ends thereof to the first frame portion by the flexible members.

2. A seat construction as in claim 1 wherein the auxiliary springs are secured to each other as are the primary springs by elongated wire-like members and clips.

3. A seat construction as in claim 1 wherein the first and second frame portions are horizontally spaced and function as part of a horizontal seat cushion of the seat.

4. A seat construction as in claim 3 wherein the first frame portion extends along the exposed front edge of the seat cushion and the auxiliary springs extend forwardly and rearwardly with respect to the seat.

5. A seat construction as in claim 1 wherein the first and second frame portions are spaced vertically and function as part of a vertical seat back of the seat with the auxiliary springs located adjacent the upper exposed edge of the seat back.

6. A seat construction according to claim 5 wherein the primary springs include lower portions that are convex with respect to padding supported thereby and have upper ends adjacent the intermediate locations where the auxiliary springs are secured to the primary springs.

7. A seat construction as in claim 1 wherein the flexible members comprise cloth-like strips.

* * * * *